US006691664B2

(12) United States Patent
Pisano et al.

(10) Patent No.: US 6,691,664 B2
(45) Date of Patent: Feb. 17, 2004

(54) DIRECT PORT ROTARY VALVE MECHANISM WITH VARIABLE TIMING FOR INTERNAL COMBUSTION ENGINES

(76) Inventors: Joseph Samuel Pisano, 31 Raynor Ave., Mount Vernon, NY (US) 10552; Joseph Michael Pisano, 31 Raynor Ave., Mount Vernon, NY (US) 10552

( * ) Notice: Subject to any disclaimer, the term of this patent is extended or adjusted under 35 U.S.C. 154(b) by 0 days.

(21) Appl. No.: 10/116,547

(22) Filed: Apr. 4, 2002

(65) Prior Publication Data

US 2002/0148428 A1 Oct. 17, 2002

Related U.S. Application Data

(60) Provisional application No. 60/283,172, filed on Apr. 12, 2001.

(51) Int. Cl.[7] ..... F01L 7/00
(52) U.S. Cl. ..... 123/190.2; 123/190.17
(58) Field of Search ..... 123/190.2, 190.17

(56) References Cited

U.S. PATENT DOCUMENTS 4,036,184 A * 7/1977 Guenther ..... 123/190.2
4,163,438 A * 8/1979 Guenther et al. ..... 123/190.2
4,864,984 A * 9/1989 Blish ..... 123/190.2
5,309,876 A * 5/1994 Schiattino ..... 123/190.2
5,410,996 A * 5/1995 Baird ..... 123/190.2
5,572,967 A * 11/1996 Donaldson, Jr. ..... 123/190.2
5,579,730 A * 12/1996 Trotter ..... 123/190.2
5,906,180 A * 5/1999 Wilke ..... 123/190.2
6,443,110 B2 * 9/2002 Qattan ..... 123/190.2
6,443,116 B1 * 9/2002 Dahlborg ..... 123/190.2

* cited by examiner

*Primary Examiner*—Henry C. Yuen
*Assistant Examiner*—Jason Benton

(57) ABSTRACT

Disclosed is a variably timed rotary valve mechanism for controlling the air/fuel intake into and exhaust gases out of an internal combustion engine. There are two rotary valve shafts, one intake and one exhaust, that contain two intake and two exhaust valve ports per engine cylinder. These rotary valve shafts are driven by and synchronized with the engine crankshaft via a conventional timing belt. The timing of each of these rotary valve shafts relative to the crankshaft can be varied individually through hydraulic servomotors under control of a computerized engine management system.

5 Claims, 4 Drawing Sheets

SEC. A-A

SEC. B-B

PLAN VIEW

DIRECT PORT ROTARY VALVE MECHANISM WITH VARIABLE TIMING FOR INTERNAL COMBUSTION ENGINES

CROSS REFERENCE TO RELATED APPLICATIONS

Provisional Patent Application No. 60/283,172 Filed Apr. 12, 2001

Applicants:

Joseph Samuel Pisano

31 Raynor Avenue, Mount Vernon, N.Y. 10552

Joseph Michael Pisano

31 Raynor Avenue, Mount Vernon, N.Y. 10552

REFERENCES CITED

U.S. patents:

U.S. Pat. No. 4,354,459 Maxey

U.S. Pat. No. 4,969,918 Taniguchi

U.S. Pat. No. 5,152,259 Bell

U.S. Pat. No. 5,706,775 Schweter et al.

BACKGROUND OF INVENTION

This invention relates to an improved valve mechanism for an internal combustion engine of the piston and cylinder type.

Specifically to an improved rotary valve mechanism employed to control the intake of the air/fuel mixture into the combustion chamber and also exhaust gases out of the combustion chamber.

Prior art pertaining to this subject all cites the well-known advantages of rotary valve mechanisms as compared to poppet valve designs. However to date all previous patents were concerned with sealing the intake and exhaust ports from the combustion chamber or varying the valve timing to gain combustion efficiency and emission control.

Prior designs have obscured the primary benefit of the rotary valve system. The rotary valve system presented here embodies the essential requirements of a rotary valve system. That is it eliminates as many complicated moving parts as possible and can be mass-produced in an economic manner.

The embodiment presented here has very high air/fuel flow characteristics due to the large unobstructed four valve ports per cylinder and essentially has only two moving rotary valve shafts, one intake and one exhaust featuring a variable timing mechanism.

SUMMARY OF THE INVENTION

The rotary valve system presented herein is used in an internal combustion engine of the piston and cylinder type that has a cylinder encasement such that a block and horizontally split cylinder head would be formed with a plurality of cylinders.

There are two rotary valve shafts which are encased in the horizontally split head, one shaft for the intake ports and one shaft for the exhaust ports. Each shaft contains two transverse bores for each engine cylinder. When the intake rotary valve shaft is rotated the ports formed by these bores become aligned with their respective intake passages from the cylinder head into the combustion chamber. This allows the air/fuel mixture to pass into the combustion chamber. When the intake rotary valve rotates such that these transverse ports are perpendicular to the intake passage from the head to the combustion chamber the chamber sealed by the solid portion of rotary valve shaft on its respective combustion chambers seals. Similarly when the exhaust rotary valve rotates such that its exhaust ports are aligned with its corresponding exhaust ports in the cylinder head and the combustion chamber it allows exhaust gases to exit from the combustion chamber. Likewise, when exhaust rotary valve rotates such that its ports are perpendicular to the exhaust ports in the combustion chamber the chamber is sealed.

The timing of intake rotary valve shaft and the exhaust rotary on shaft is synchronized with the engine crankshaft by means of a cog belt or timing chain. Further the timing of the intake and exhaust rotary valve shafts are individually variable through the action of individual hydraulic servomotors under the control of a computerized engine management system. This allows for each rotary valve shaft to be advanced or retarded relative to the crankshaft position under the control of the computer driven servomotors.

The unobstructed path of the four ports for each cylinder and their large diameters allows for very high airflow quantities in and out of the combustion chambers. Further the contoured shape of the rotary valve shafts allow for the combustion chamber head and to be a very efficient hemispherical configuration.

BRIEF DESCRIPTION OF THE DRAWINGS

The structure, operation, and advantages of the preferred embodiment of the invention presented will become apparent upon consideration of the following descriptions taking in conjunction the accompanying drawings.

DETAILED DESCRIPTION OF THE INVENTION

Depicted schematically throughout are components commonly known to internal combustion engines such as the engine block, crankshaft, pistons, connecting rods, cylinder heads, combustion chambers and valve ports. Omitted from the schematic drawings depicting this invention are other common internal combustion engine parts such as; water cooling passages throughout the engine block and cylinder heads, piston rings, oil galleys and seals, spark plugs and other common ignition system components. While the description of the preferred embodiment is generally directly toward a four stroke internal combustion engine it is intended that the variable rotary valve system of this invention is equally applicable to a two stroke engine and any other kind of engine that employs intake and exhaust valves including pneumatic compressors and pneumatic actuators.

While the descriptions that follow are schematically detailed as a one or two cylinder engine it must be appreciated that this variable rotary valve system is equally applicable to multi-cylinder engine applications.

Figure 1:
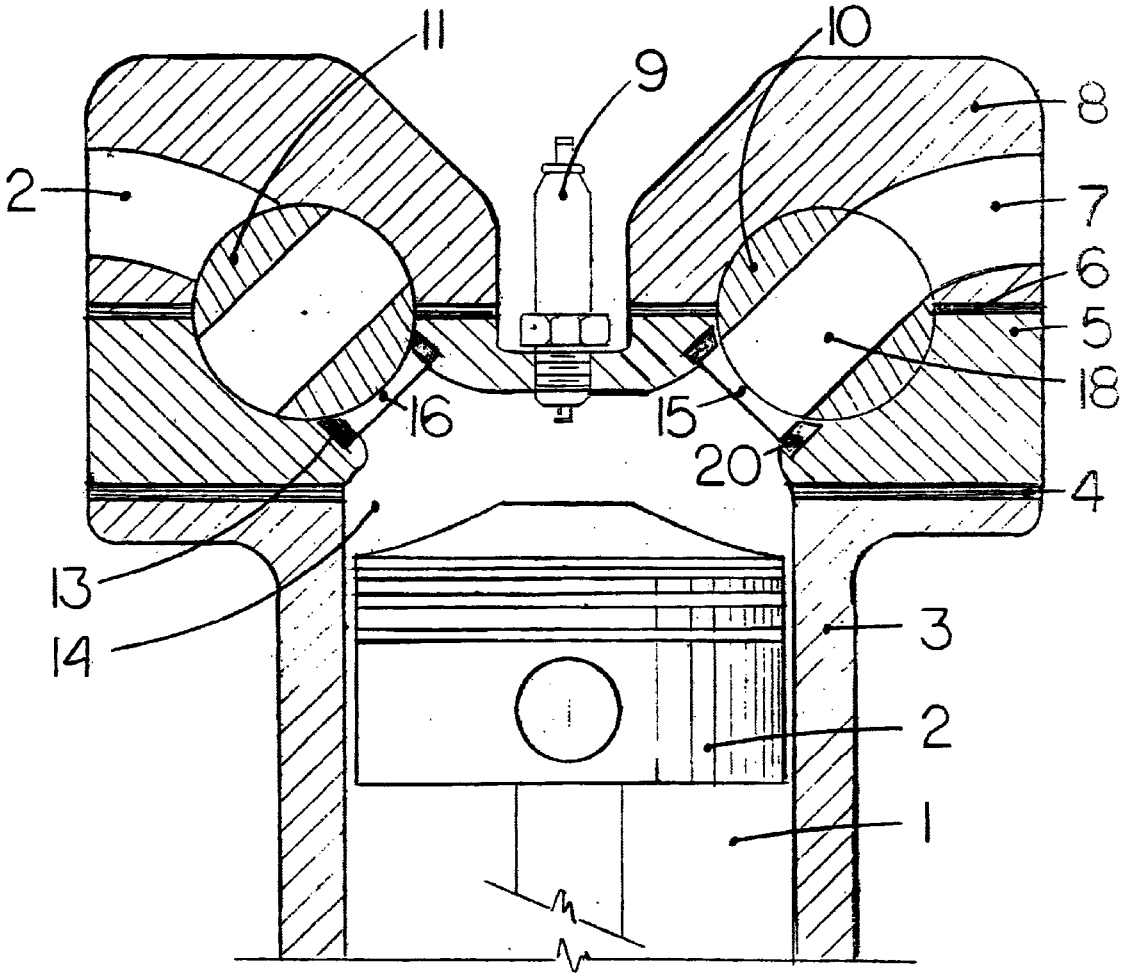
FIG. 1 is a section through the engine from the end view. It shows the engine block with the cylinder walls and piston. This section further shows that the cylinder head is split horizontally for ease of fabrication and maintenance. The cylinder head is shown with the intake and exhaust rotary valves in place. It shows the intake valve in the open position such that the air/fuel mixture can pass into the combustion chamber. If further shows the exhaust rotary valve in the closed position against its valve seal such that the exhaust path out of the combustion chamber is blocked.

FIG. 1 This is a section from the end view of the engine. It shows the engine block 3 with the cylinder wall 1 and piston 2. The engine block is joined to the lower section of the cylinder head 5 at the head gasket 4. Bolts (not shown) would secure the lower section of the cylinder head 5 to the block 3. The bolts would pass through the block bosses from below into blind treaded holes in the lower half of the cylinder head 5. In this way the upper half of the cylinder head 8 could be removed without disturbing the seal 4 between the block 3 and the lower head section 5. The upper half of the cylinder head 8 also has a gasket 6 between the mating surfaces of the upper and lower cylinder head. The upper half of the cylinder head 8 would be secured to the lower half of the cylinder head 5 by bolts (not shown) which would allow the disassembly of the upper head 8 from the lower head 5 for access to the variable rotary valve mechanisms 10 and 11.

The variable rotary valve shaft 10 has a transverse port 18 through it to allow the air/fuel mixture to enter the combustion chamber 14 through the lower head intake port 15 and upper head intake port 7 when in alignment as shown. The variable rotary valve shaft 10 is sealed by seal 20 fixed in the lower portion of the cylinder head 5.

Figure 4:
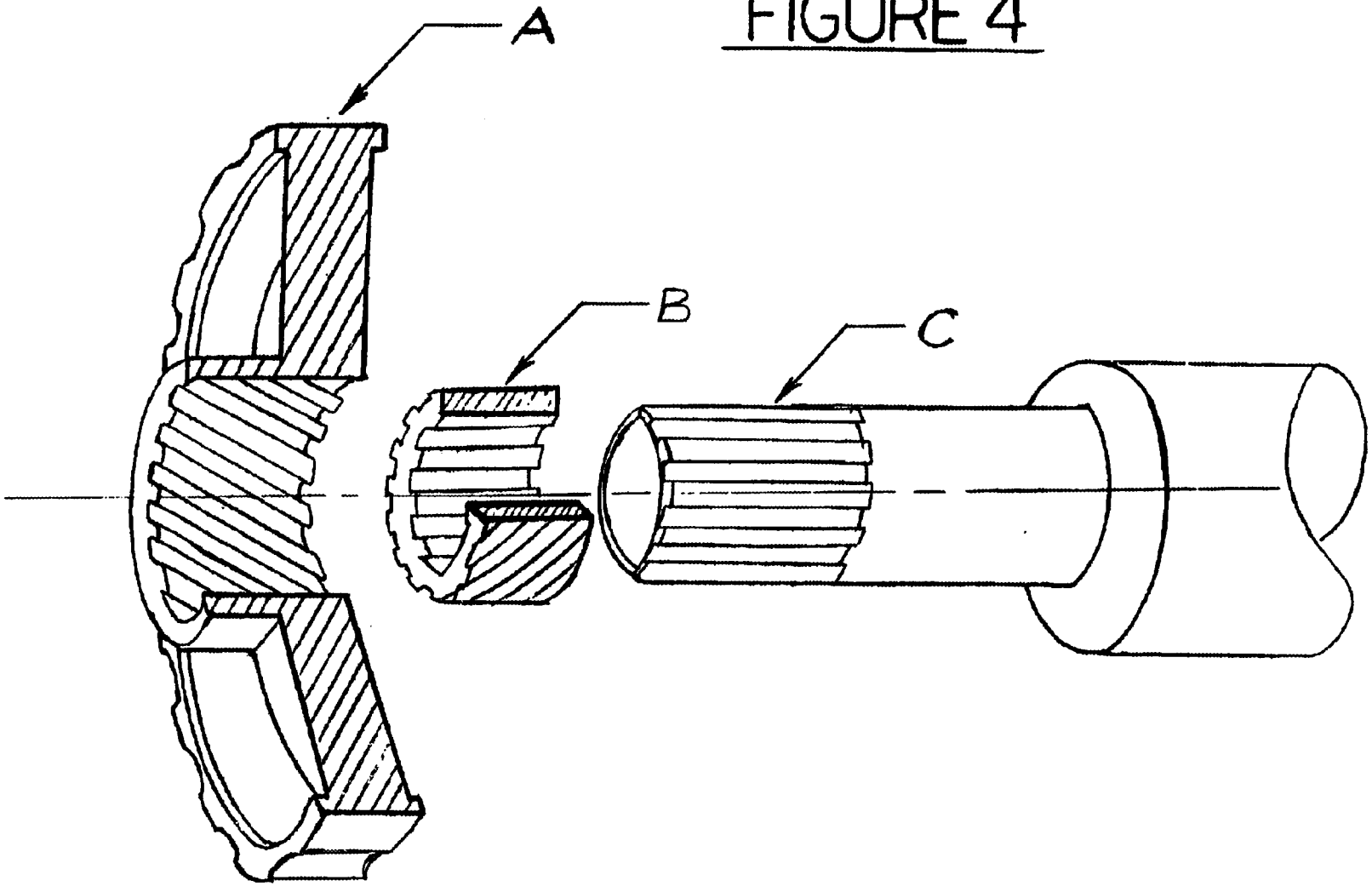
FIG. 4 is a perspective view of the rotary valve shaft drive sprocket that would be driven from the engine crankshaft by a cog belt which is not shown. Each rotary valve shaft would be driven by its own sprocket. Each sprocket is advanced or retarded by a hydraulic servomotor and gear mechanism.

The variable rotary exhaust valve 11 is shown rotated in the closed position and is sealed at the combustion chamber by seal 13. In this position variable rotary valve 11 does not provide an exhaust flow path through port 16 and port 12. Both variable rotary valves 10 and 11 would be synchronized and timed to the crankshaft as depicted in FIG. 4. The spark plug 9 would be fired in the appropriate sequence by an electronic ignition system that is not shown.

Figure 2:
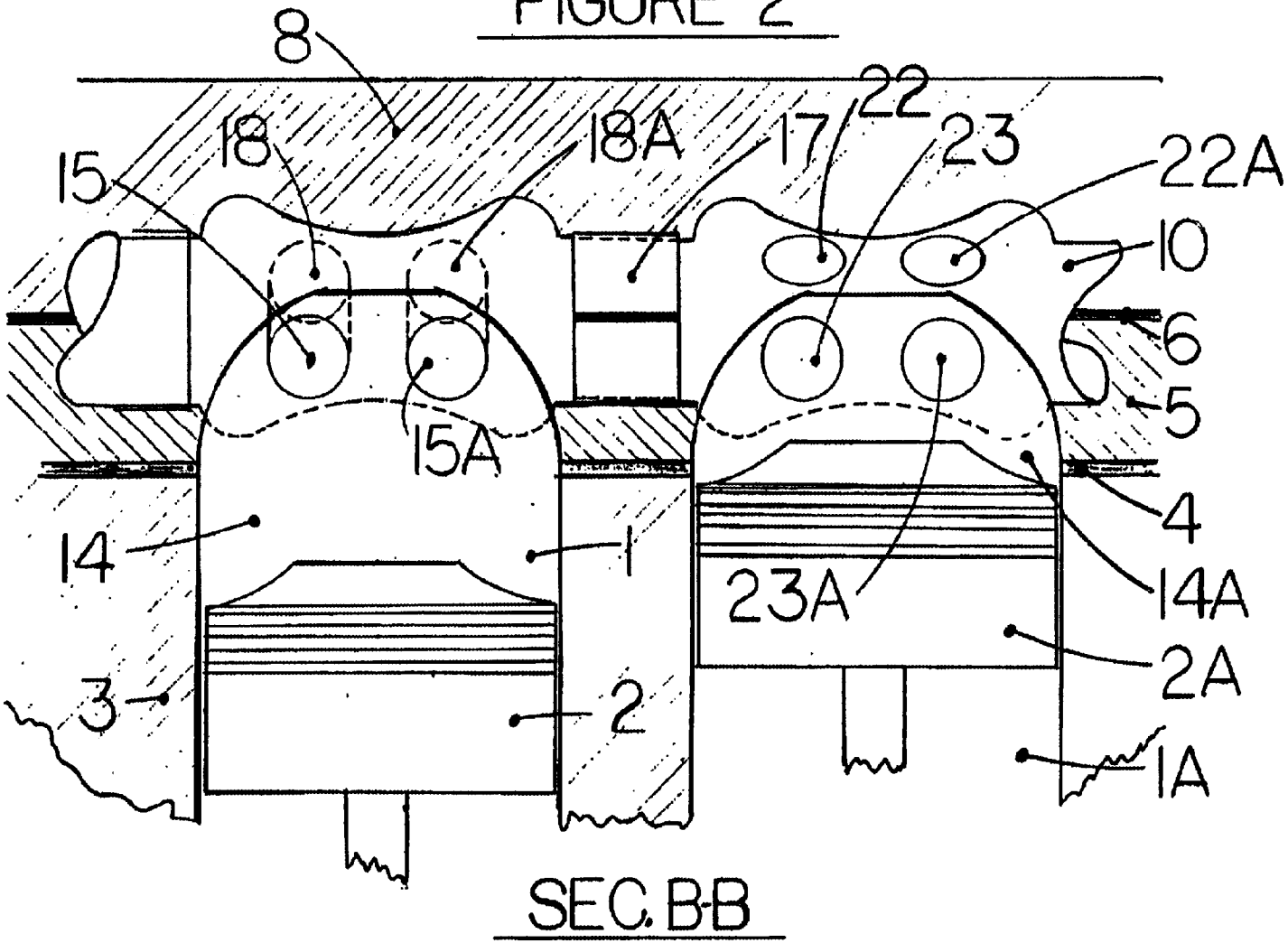
FIG. 2 shows a side view section through two adjacent cylinders. This view shows you the placement of the rotary valve shaft in the head and the relative position of the shaft to the combustion chamber. It further shows the unique shape of the rotary valve shaft and its position relative to the combustion chamber. The position of the spark plug in this section is omitted for clarity.

FIG. 2 shows a side view section through two adjacent cylinders 1 and 1A. It shows the pistons 2 and 2A within the cylinder walls 1 and 1A. In addition to what is described in FIG. 1 this view shows the shape of the variable rotary intake valve shaft 10. This variable rotary intake valve shaft is supported by bearings 17 which would be oil fed. FIG. 2 further shows that the variable rotary intake valve 10 would have two ports per cylinder 18 and 18A which when rotated into alignment with cylinder head ports 15 and 15A would allow the air/fuel mixture to pass into the combustion chamber 14. Although not shown the variable rotary exhaust valve shaft would be configured in the same fashion.

As can be seen by looking at FIG. 1 and FIG. 2 when ports 18 and 18A of the variable rotary intake shaft 10 are rotated into alignment with ports 15 and 15A and ports 7 and 7A (Not shown) an unrestricted airflow path is provided into the combustion chamber. This flow path configuration is superior to and in part what differentiates this design from other rotary valve configurations. The adjacent cylinder 1A shows piston 2A near the top of its travel and ports 22 and 22A through the variable rotary valve shaft out of alignment with ports 23 and 23A in the combustion chamber 14A thus sealing the combustion chamber 14A as would be common on a compression stroke.

Figure 3:
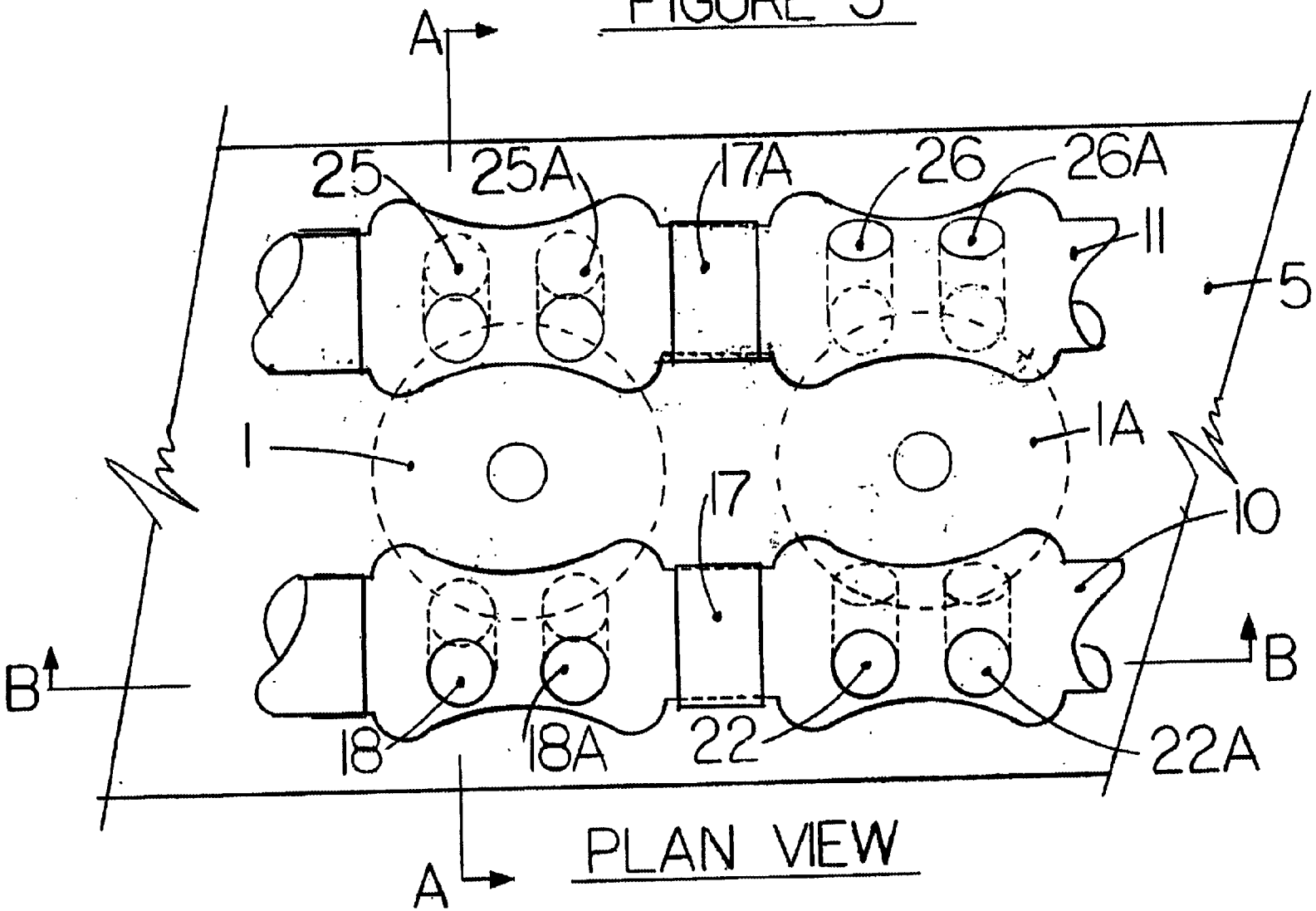
FIG. 3 shows a view of the engine looking from the top down. It further shows the intake and exhaust rotary valves and their position relative to the cylinders below. It further shows the unique shape of both the intake and exhaust rotary valve shafts and clearly shows two intake ports and two exhaust ports in each rotary valve shaft for each combustion chamber. It further shows the valve ports aligned in the same position as shown in FIG. 1.

FIG. 3 This drawing is a Plan view showing two adjacent cylinders 1 and 1A and both the intake and exhaust variable rotary valve shafts 10 and 11 sitting in the lower half of cylinder head 5 supported by bearings 17 and 17A. Further shown is the configuration of each variable rotary valve shaft 10 and 11 above and adjacent to the two cylinders 1 and 1A and communicating with the combustion chambers 14 and 14A (shown in FIG. 2) through the ports 18 and 18A and ports 22 and 22A in the variable intake rotary valves shaft and through ports 25 and 25A and 26 and 26A in the variable exhaust rotary valve shaft.

The rotary intake valve 10 when rotated communicates with cylinder 1 through ports 18 and 18A. Similarly ports 22 and 22A when in alignment will allow the unrestricted flow of the air/fuel mixture into cylinder 1A. The rotary exhaust valve 11 when rotated into the proper position allows ports 25 and 25A to pass exhaust gases from cylinder 1 after combustion is complete.

FIG. 4 This drawing is a perspective view of the variable timing mechanism that advances or retards the timing of the intake rotary valve shaft and the exhaust rotary valve shaft relative to the position of the engine crankshaft.

For simplicity FIG. 4 depicts only the variable intake rotary valve shaft and mechanism to advance or retard the valve timing relative to the engine crankshaft. The exhaust rotary valve mechanism is essentially identical in form and function. As shown in FIG. 4 the intake rotary valve shaft "C" would be attached to and controlled by its respective rotary valve shaft sprocket "A". The rotary valve shaft sprocket "A" is driven by a cog belt not shown. The sprocket "A" is attached to the rotary intake valve shaft "C" by gear coupling "B". The gear coupling "B" is moved forward or backward axially on the splined shaft "C" of the rotary valve intake shaft by a hydraulic servomotor (not shown). This servomotor is actuated under the control of the electronic engine management system. The movement of coupling "B" on splined shaft "C" causes the sprocket "A" to advance or retard the rotary valve shafts due to the action caused by helical gear "B". This control of the rotary valve timing will allow the engine management system to automatically adjust engine power and emissions.

What we claim is:

1. In an internal combustion engine having a cylinder encasement formed with one or more cylinders and one or more intake ports and an exhaust ports for each cylinder, an improved rotary valve system for said engine comprising of two rotary valve shafts which are contoured to essentially match the shape of the substantially hemispherical shaped cylinder head chambers which are encased in a horizontally split head, one shaft for the intake ports and one shaft for the exhaust ports and each rotary valve shaft contains one or more transverse bores for each engine cylinder such that when the rotary valve shafts are rotated the ports formed by these bores become aligned with their respective intake and exhaust passages from the cylinder head into the substantially hemispherical combustion chamber allowing the air/fuel mixture to pass into and out of said combustion chamber and when the rotary valve shafts are rotated such that these transverse ports are perpendicular to the intake or exhaust passages from the head to the combustion chamber the chamber is sealed by the solid portion of rotary valve shafts against their respective combustion chambers seals and the timing of said rotary valve shafts is mechanically synchronized with the engine crankshaft and further the timing of the intake and exhaust rotary valve shafts relative to the engine crankshaft is individually variable through the action of individual hydraulic servo motors and helical gear drive mechanisms attached to each rotary valve shaft under the control of a computerized engine management system that advances or retards the rotary valve shafts relative to the crankshaft through the action of the helical gears and splined shaft rotating the rotary valve shafts.

2. The apparatus as recited in claim 1 wherein said horizontally split cylinder head and intake rotary valve shafts provide one or more essentially straight paths per cylinder from the intake ports of the head through the rotary valve ports, through the combustion chamber ports into the essentially hemispherical combustion chamber.

3. The apparatus as recited in claim 1 wherein said horizontally split cylinder head and exhaust rotary valve shafts provide one or more essentially straight paths per cylinder out of the essentially hemispherical combustion chamber through the exhaust ports of the combustion chamber, through the rotary valve ports through the exhaust ports of the head.

4. The apparatus as recited in claim 1 wherein said mechanically driven variable timing mechanisms individually advances or retards the timing of the intake rotary valve shaft and the exhaust rotary valve shaft relative to the position of the engine crankshaft by the action of individual hydraulic servomotors which position the rotary valve shafts through the action of a helical gear coupling and the splined shafts of the rotary valves under the control of a computerized engine management system which will compare the engine power and emission requirements to the rotary valve timing.

5. The apparatus as recited in claim 1 wherein said contoured shape of the rotary valve shafts at each combustion chamber essentially matches the internal shape of the substantially hemispherical combustion chamber allowing the combustion chamber intake and exhaust ports to be a minimum length providing superior air flow characteristics.

* * * * *